US005776251A

United States Patent [19]

Irie et al.

[11] Patent Number: 5,776,251

[45] Date of Patent: Jul. 7, 1998

[54] DUPLEX TYPE COATING APPARATUS AND COATING SYSTEM

[75] Inventors: Nobuaki Irie; Takao Ishida; Akiyoshi Hashimoto; Yasutomi Yoshimura, all of Nara, Japan

[73] Assignee: Hirano Tecseed Co., Ltd., Nara, Japan

[21] Appl. No.: 720,599

[22] Filed: Sep. 30, 1996

[30] Foreign Application Priority Data

Jul. 22, 1996 [JP] Japan ..... 8-192525

[51] Int. Cl.[6] ..... B05C 3/02

[52] U.S. Cl. ..... 118/411; 118/405; 118/410; 118/419; 118/663; 118/665; 118/674; 118/679; 118/683; 118/695; 118/712; 425/113; 425/462; 425/466

[58] Field of Search ..... 118/405, 410, 118/411, 419, 663, 665, 674, 679, 683, 695, 712; 427/209, 210, 286, 287, 356, 357; 425/113, 133.5, 462, 466

[56] References Cited

U.S. PATENT DOCUMENTS 4,231,318 11/1980 Zink .

FOREIGN PATENT DOCUMENTS 3-72976 3/1991 Japan .

*Primary Examiner*—Peter Chin
*Assistant Examiner*—Michael P. Colaianni
*Attorney, Agent, or Firm*—Jordan and Hamburg

[57] ABSTRACT

In a duplex type coating apparatus, a left-right pair of dies and are disposed on opposite sides of a carrying path of a web, the dies and are each made up of an upper member and a lower member, a tip part of the lower member projects further toward the carrying path than a tip part of the upper member, and coating liquid discharge passages are inclined in the direction of the carrying path of the web. As a result, because the same amount of coating liquid is discharged from each of the dies and coated onto each side of the web, it is possible to carry out coating at the same coating thickness and in the same position on both sides of the web.

9 Claims, 14 Drawing Sheets

DUPLEX TYPE COATING APPARATUS AND COATING SYSTEM

BACKGROUND OF THE INVENTION

This invention relates to a duplex type coating apparatus and a coating system capable of simultaneously applying a coating liquid to both sides of a long web made of cloth, plastic film, metal sheet, mesh-form metal sheet or porous metal sheet or the like and to a battery electrode material manufactured using the same.

One known duplex type coating apparatus of this kind is the twin-blade type coating apparatus.

In the twin-blade type coating apparatus, a pair of dies are arranged on opposite sides of a carrying path of a web travelling in the vertical direction and a pair of blades are disposed above this pair of dies. The web is transported vertically upward from below, a coating liquid is discharged from the pair of dies and coated onto both sides of the web and the coating thickness thereof is kept constant by excess coating liquid then being scraped off by the blades (U.S. Pat. No. 4,231,318).

However, there is a problem in that when the web travelling in the vertical direction displaces in the left-right direction the thickness of the coating changes.

There are duplex type coating apparatuses wherein, to solve this problem, when the web is travelling in a central position between the pair of dies the coating liquid is discharged from the pair of dies at the same pressure and when the web has displaced to the left or to the right the position of a die is moved and the discharge pressure thereby changed so that the coating thickness becomes uniform (JP-A-03072976).

However, in this kind of duplex type coating apparatus there is a problem in that in order to maintain the uniformity of the coating thickness it is necessary to move one of the dies, the movement-based coating thickness adjustment being difficult to implement.

Accordingly, the present invention provides a duplex type coating apparatus capable of easily coating both surfaces of a web with a uniform coating thickness.

Furthermore, due to the spread of portable telephones and portable information terminals, the mass production of spiral electrode type lithium batteries used in such equipment being carried out on a large scale. In mass-producing the lithium batteries it is necessary to carry out so-called stripe coating, wherein a slurry composite (coating liquid) consisting mainly of an electrode activating substance is coated onto a bandlike hoop material (web) made of copper foil or aluminum foil in such a way as to alternately form coated parts and uncoated parts in the widthwise direction of the hoop material, and furthermore it is necessary to coat the slurry composite at the same positions on both sides of the hoop material.

However, in the two duplex type coating apparatuses described above, although it is possible to coat a continuous coating liquid onto the web, it has not been possible to carry out stripe coating whereby coated areas and uncoated areas are formed alternately in the widthwise direction.

Accordingly, the present invention also provides a duplex type coating apparatus capable of duplex coating and also capable of stripe coating.

Also, in the manufacture of a lithium battery, because the copper foil or aluminum foil bandlike hoop material consists of a mesh-form or porous sheet, when coating the slurry composite onto this it is necessary to make the slurry composite penetrate into through holes passing through this mesh sheet or porous sheet and also to coat in the same positions on both sides of the sheet. Accordingly, the present invention also provides an electrode material for a battery made by causing a slurry composite to penetrate into through holes of a mesh-form or porous metal sheet and coating the same positions on both sides of the sheet.

SUMMARY OF THE PRESENT INVENTION

Thus, it is a first object of the invention to provide a duplex type coating apparatus capable of easily coating both surfaces of a web with a uniform coating thickness, it is a second object of the invention to provide a duplex type coating apparatus capable of duplex coating and also capable of stripe coating, and it is a third object of the invention to provide an electrode material for a battery made by causing a slurry composite to penetrate into through holes of a mesh-form or porous metal sheet and coating the same positions on both sides of the sheet.

A duplex type coating apparatus of the invention comprises a pair of dies disposed on opposite sides of a carrying path of a web, a liquid reservoir for coating liquid provided inside each of the dies, a discharge port for discharging coating liquid provided in a widthwise direction of the web in a tip part of each of the dies, a coating liquid discharge passage extending from the liquid reservoir to the discharge port in each of the dies, and coating liquid supplying means for supplying coating liquid to the liquid reservoirs, the duplex type coating apparatus applying coating liquid to both sides of a web by discharging the same amount of coating liquid from each of the pair of discharge ports onto the travelling web; a web entry side edge part of each discharge port projecting further than a web exit side edge part of the discharge port and the gap between the entry side edge parts of the pair of dies being wider than the gap between the exit side edge parts, and the discharge passage being inclined in the carrying direction.

In the coating operation of the duplex type coating apparatus described above the web is carried along the carrying path. The same amount of coating liquid is discharged onto the travelling web from the discharge ports of each of the pair of dies disposed on opposite sides of the carrying path, and coating liquid is thereby coated onto both sides of the web.

A coating pressure acts on the web at the tip of the exit side edge part of each discharge port, and consequently it is possible to coat the coating liquid smoothly onto the web. Because the discharge passage is inclined in the direction of the carrying path of the web, the coating liquid flows in the carrying direction of the web and does not leak out from between the tip parts of the pair of dies. Furthermore, because the gap between the entry side edge parts of the discharge ports is narrower than the gap between the exit side edge parts thereof, coating liquid is prevented from leaking out from between the entry side edge parts.

A further feature of the present invention provides a duplex type coating apparatus wherein the exit side edge part of the discharge port of each of the pair of dies is formed so as to have a curved surface extending from the discharge passage to the tip part of the die.

In the duplex type coating apparatus described above, because the exit side edge part of the discharge port is formed into a curved surface shape, the coating pressure on the web gradually increases and a maximum coating pressure acts at the tip part of the exit side edge part and coats liquid discharged from the discharge port onto the web and makes the coated surface smooth. Also, coating liquid flows smoothly onto the web.

A still further feature provides a duplex type coating apparatus wherein the tip part of the entry side edge part of the discharge port of each of the pair of dies is formed so as to be parallel with the carrying path.

In the discharge port described above, because the shape of the tip part of the die is formed so as to be parallel with the carrying path, it is possible to prevent coating liquid from leaking from between the tip parts of the pair of dies.

Another feature of the present invention provides a duplex type coating apparatus wherein there is provided die moving means for moving at least one of the pair of dies in a direction orthogonal to the carrying path and the gap between the pair of dies is thereby made variable.

In the duplex type coating apparatus described above, because it is possible to move at least one of the pair of dies using the die moving means, it is possible to change the gap between the pair of dies. As a result, it is possible to transport webs of different thicknesses. Also, when there is seam in the web, it is possible to make the gap between the pair of dies large by means of this die moving means and thereby ensure that this seam portion travels smoothly between the pair of dies.

Yet another feature of the present invention provides a duplex type coating apparatus wherein there is provided a die turning means for changing the angles of inclination of the pair of dies and the inclination of each of the pair of dies with respect to the carrying path is thereby made variable.

In the duplex type coating apparatus described above, because it is possible to change the inclinations of the pair of dies with respect to the carrying path using the die turning means, it is possible to incline the coating liquid discharge direction when necessary.

A still further feature of the present invention provides a duplex type coating apparatus set forth in claim 6 wherein in the discharge passages discharge spaces capable of discharging coating liquid and blocked spaces not capable of discharging coating liquid are formed alternately in the width direction of the web.

In the duplex type coating apparatus described above, because discharge spaces and blocked spaces are formed alternately in the width direction of the web, it is possible to carry out stripe coating.

The present invention also provides a duplex type coating apparatus further comprising carrying velocity detecting means for detecting the carrying velocity V of the web, a constant delivery pump for supplying a fixed delivery amount of coating liquid per rotation to each of the liquid reservoirs of the pair of dies in the same quantity, and first controlling means for, on the basis of the carrying velocity V from the carrying velocity detecting means, controlling the speed N of the constant delivery pump such that $$N=(D\times W\times V)/(K1\times Q),$$

where D is a set wet coating thickness, W is a set coating width of the web, Q is the delivery amount per rotation of the constant delivery pump and K1 is a constant.

In the duplex type coating apparatus described above, the speed N of the constant delivery pump is controlled such that $$N=(D\times W\times V)/(K1\times Q)$$

by the first controlling means. When this is done, the coating liquid necessary for the set coating thickness of the web is always supplied at a fixed rate from the constant delivery pump. As a result, it is possible to coat coating liquid onto both sides of the web with the same coating thickness at all times.

The present invention also provides a duplex type coating apparatus further comprising carrying velocity detecting means for detecting the carrying velocity V of the web, a constant delivery pump for supplying a fixed delivery amount of coating liquid per rotation to each of the liquid reservoirs of the pair of dies in the same quantity, coating thickness detecting means for detecting the average coating thickness Dp in the width direction of the web, and second controlling means for on the basis of the carrying velocity V from the carrying velocity detecting means and the average coating thickness Dp from the coating thickness detecting means controlling the speed N of the constant delivery pump such that $$N=(Ds\times V\times K0)/Dp,$$

where Ds is a set wet coating thickness and K0 is a constant.

In the duplex type coating apparatus described above, the speed N of the constant delivery pump is controlled such that $$N=(Ds\times V\times K0)/Dp$$

by the second controlling means. When this is done, the coating liquid necessary for the set coating thickness of the web is supplied at a fixed rate from the constant delivery pump. As a result, the amount of coating on the web is always the same on both sides and uniform.

The present invention further provides a coating system set including the duplex type coating apparatus described above, an infeed roller for feeding a web into the duplex type coating apparatus, a nip roller disposed so as to nip the travelling web with the infeed roller, an infeed motor for driving the infeed roller, tension measuring means for measuring the tension of the web disposed in the carrying path between the infeed roller and the duplex type coating apparatus, drying means for drying coating liquid coated onto the web by the duplex type coating apparatus, an outfeed roller for carrying the web dried by the drying means, a nip roller disposed so as to nip the travelling web with the outfeed roller, an outfeed motor for driving the outfeed roller, and third controlling means for driving the infeed motor so that the web is carried at a set carrying velocity and driving the outfeed motor so that the tension of the web measured by the tension measuring means assumes a predetermined value.

With the coating system described above it is possible control the carrying velocity and the web tension with the third controlling means.

The present invention further provides an electrode material for a battery made by coating a coating liquid onto both sides of a web consisting of a mesh-form metal sheet or a porous metal sheet by means of the duplex type coating apparatus described above.

Since the coating liquid is coated onto both sides of the mesh-form metal sheet or the porous metal sheet by means of the duplex type coating apparatus, the same amount of coating liquid is coated on each side and consequently coating liquid penetrates evenly into the through holes in the sheet and furthermore coating liquid is coated in the same positions on both sides.

Thus, with the duplex type coating apparatus of the present invention, because the same amount of coating liquid is discharged from each of the pair of dies and coated onto both sides of the web, it is possible to carry out coating with the same coating thickness and in the same positions on both sides of the web.

Also, there is no leaking out of coating liquid from between the pair of dies.

Furthermore, if discharge spaces and blocked spaces are provided alternately in the discharge passages, stripe coating also is possible.

Also, when coating liquid is coated onto a web consisting of a mesh-form metal sheet or a porous metal sheet from both sides by means of the duplex type coating apparatus, because it is possible to coat the coating liquid onto both sides of the metal sheet w ith the same coating thickness and in the same positions, it is possible to produce a coated sheet ideal as an electrode material of a battery.

DETAILED DESCRIPTION OF THE PRESENT INVENTION

A duplex type coating apparatus 10 of a first preferred embodiment of the invention is described with reference to FIG. 1 through FIG. 11. In the description of this preferred embodiment, up and down and left and right refer to up, down, left and right in FIG. 1, FIG. 2, FIG. 5, FIG. 7 and FIG. 9. Also, the front-rear page direction of these drawings will be referred to as the front-rear direction. This front-rear direction is also the width direction of the web 7.

a. Description of Coating System

Figure 1:
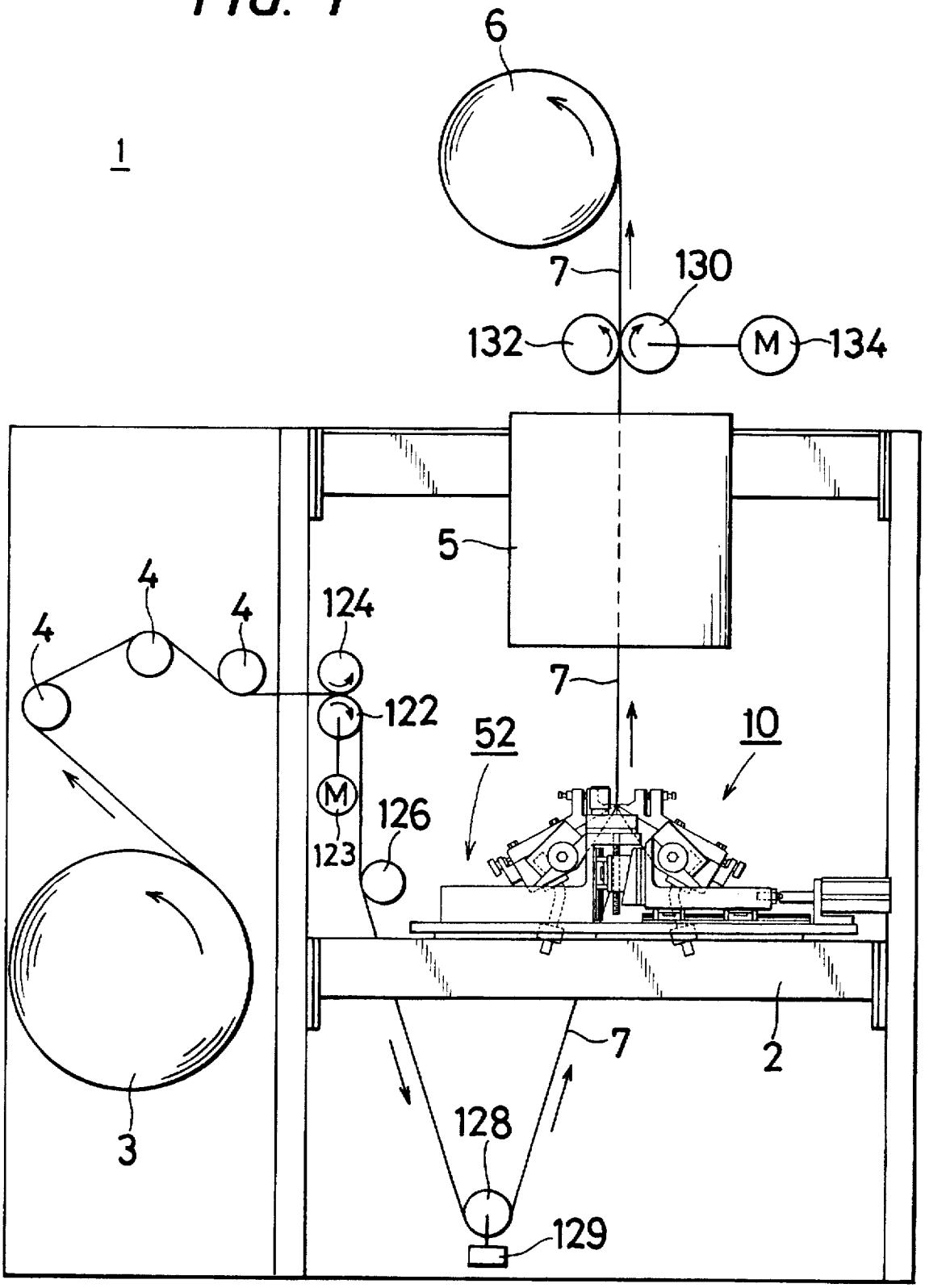
FIG. 1 is a side view showing a coating system of a first preferred embodiment of the invention.

Referring to FIG. 1, the overall construction of a coating system 1 comprising the coating apparatus 10 is described below.

The reference numeral 2 designates an installation bed on which the coating apparatus 10 is mounted.

The reference numeral 3 designates a supply roller on which a web 7 is wound.

The reference numerals 4, 4, 4 designate three guide rollers for guiding the web 7 from the supply roller 3 to an infeed roller.

The reference numeral 122 designates an infeed roller, and the reference numeral 123 designates an infeed motor for driving the infeed roller 122; and the reference numeral 124 designates a nip roller mounted facing the infeed roller 122.

The reference numeral 126 designates a guide roller for guiding the web 7 carried from the infeed roller 122 to a tension roller.

The reference numeral 128 designates a tension roller mounted below the coating apparatus 10, and on this is mounted a tension measuring device 129 for measuring the tension of the web 7. The web 7 is carried to the coating apparatus 10 after passing through the tension roller 128.

Figure 3:
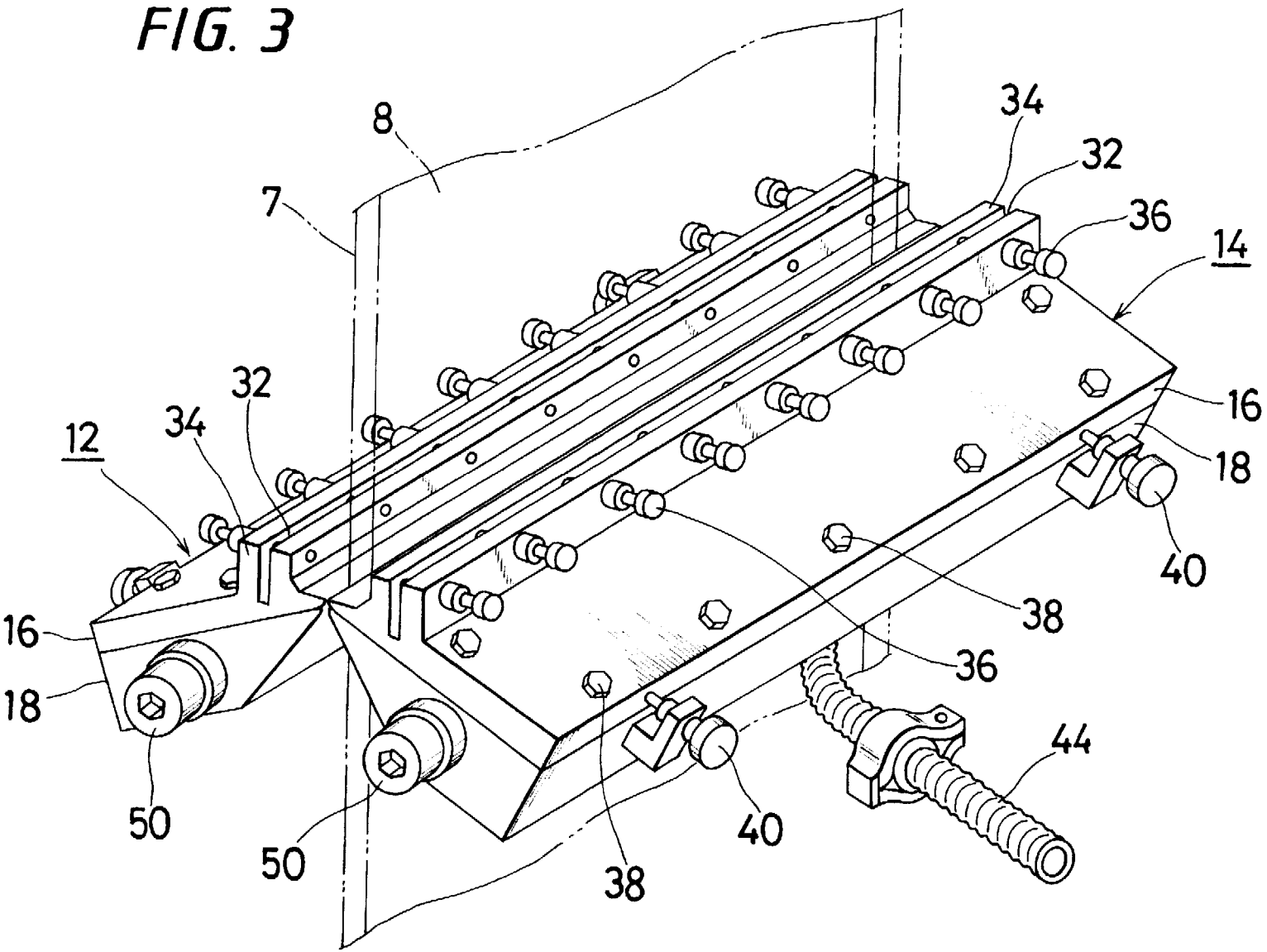
FIG. 3 is a perspective view of a left-right pair of dies.
Figure 4:
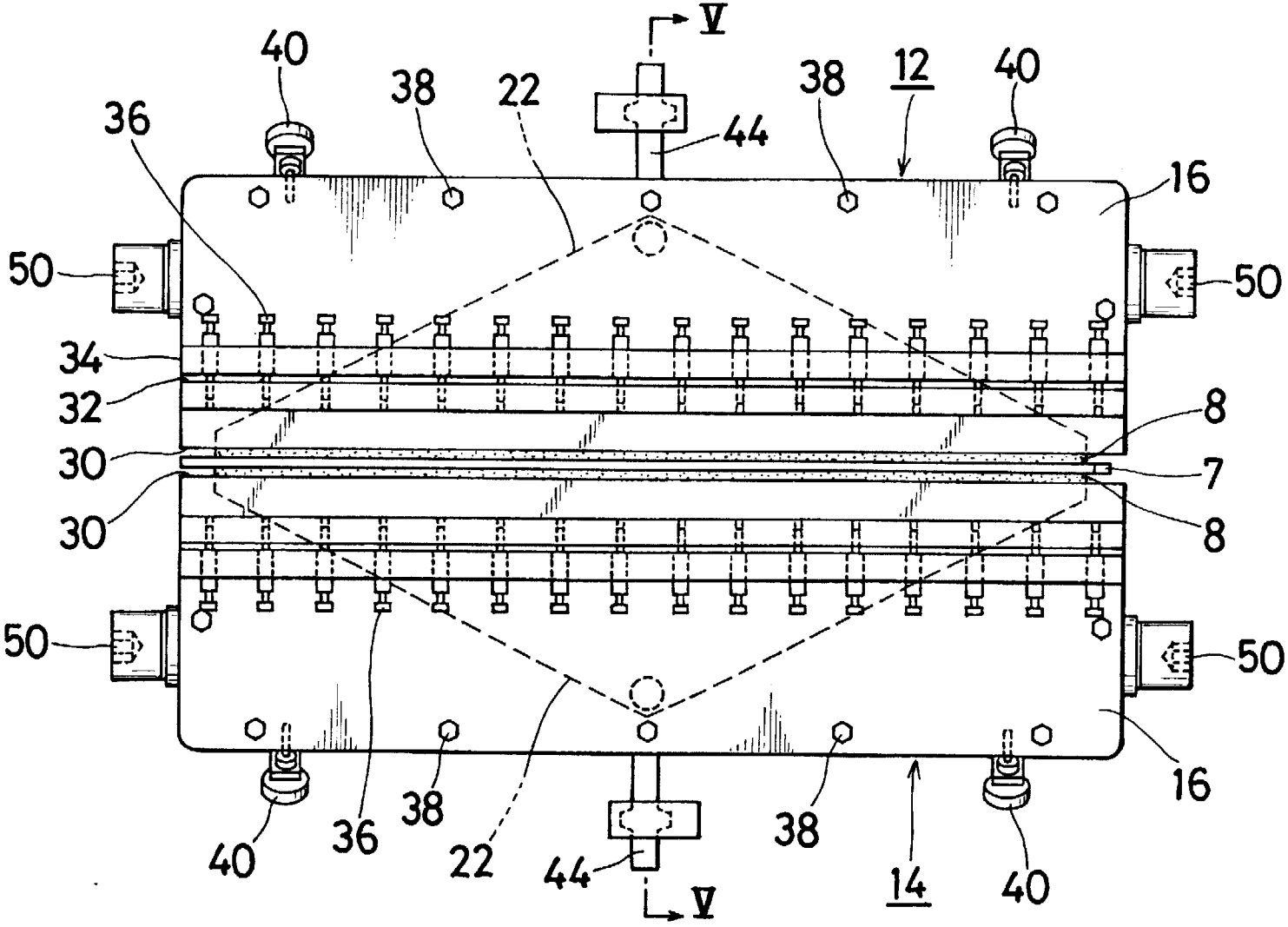
FIG. 4 is a plan view of the left-right pair of dies.
Figure 5:
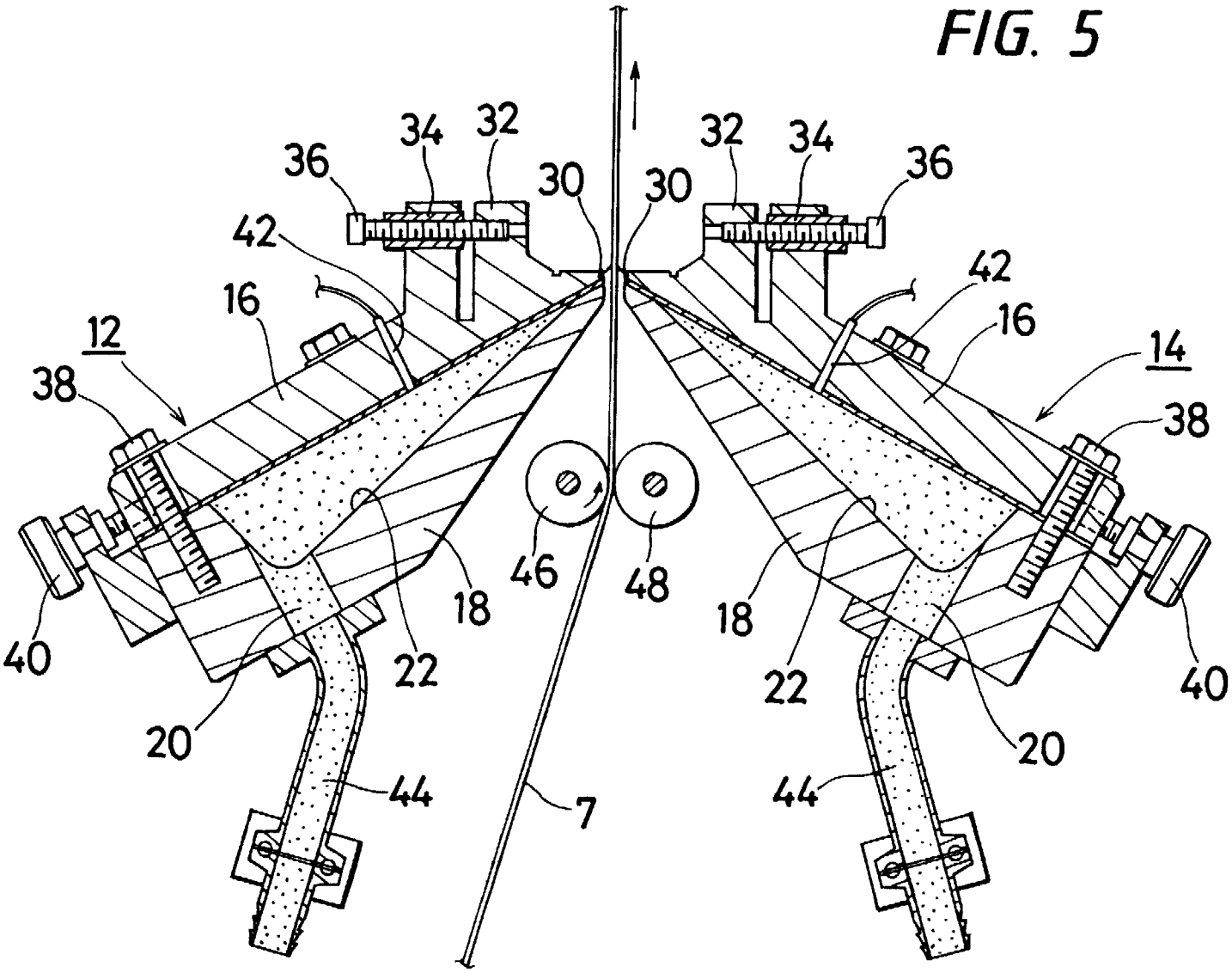
FIG. 5 is a sectional view on the line V—V in FIG. 4.

The reference numeral 5 designates a drying apparatus mounted above the coating apparatus 10. This drying apparatus 5 blows hot air at and thereby dries the web 7 on both sides of which a coating liquid 8 has been coated by the coating apparatus 10 as shown in FIGS. 3 and 4.

The reference numeral 130 designates an outfeed roller, the reference numeral 134 designates an outfeed motor for driving the outfeed roller 130 and the reference numeral 132 designates a nip roller mounted facing the outfeed roller 130.

The reference numeral 6 designates a takeup roller for taking up the web 7 after it has passed through the drying apparatus 5.

b. Description of Coating Apparatus

The coating apparatus 10 is described below, with reference to FIG. 2 through FIG. 6.

(Construction of Left-Right Pair of Dies)

The reference numerals 12 and 14 designate a left-right pair of dies for coating coating liquid 8 onto the web 7; the web 7 moves vertically upward from below between the pair of dies 12, 14, and coating liquid 8 is discharged from discharge ports 30 of the dies 12 and 14 onto both sides of the web 7. The width of each of the pair of dies 12, 14 is substantially the same as the width of the web 7.

The construction of this left-right pair of dies 12, 14 is now described; since they are left-right symmetrical, first the left side die 12 will be described.

The left side die 12 is made up of an upper member 16 and a lower member 18 so that it is splitable into upper and lower parts.

The lower member 18 is formed tapered so that it narrows toward the carrying path of the web 7, i.e. toward the right.

Figure 6:
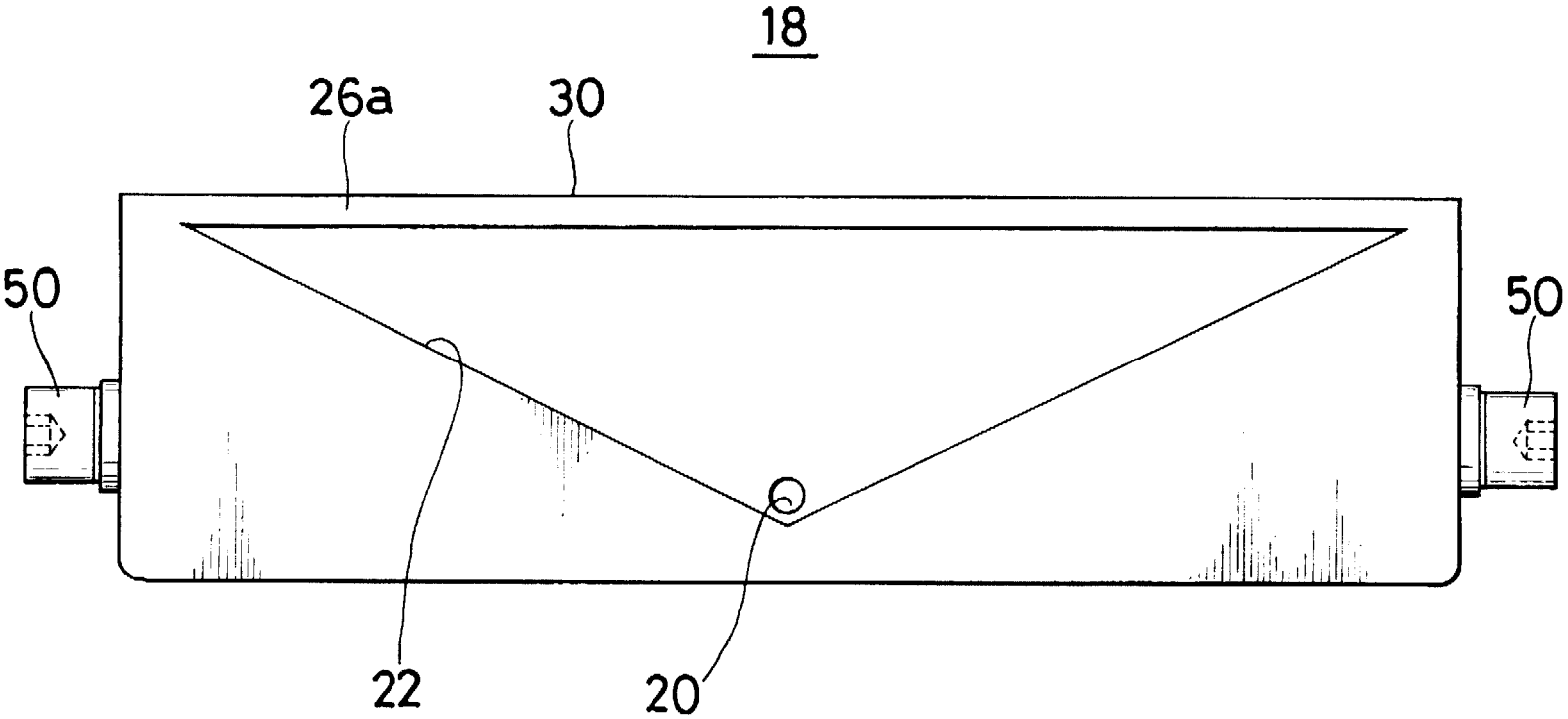
FIG. 6 is a plan view of a lower member.

A recess is formed in the upper surface of the lower member 18, and this recess constitutes a liquid reservoir 22. The right side of the liquid reservoir 22 forms a sloping surface, and its volume becomes smaller with progress toward that right side. Also, a coating liquid 8 inlet port 20 passes through the left side of the bottom of the liquid reservoir 22. The plan view shape of the liquid reservoir 22, as shown in FIG. 6, is formed in a fan-shape so that it spreads out from the inlet port 20 toward both sides. The reason for forming the liquid reservoir 22 in this way is to enable coating liquid 8 having entered through the inlet port 20 to flow smoothly to the discharge port 30 even if it is highly viscous and does not flow readily.

The upper member 16 is fitted onto the lower member 18 like a cover and the upper member 16 and the lower member 18 are fixed together by a plurality of fixing bolts 38.

The lower surface of the upper member 16 covers the liquid reservoir 22, and a discharge passage 26 is formed between the upper member 16 and the lower member 18, the right end of this discharge passage 26 constitutes the coating liquid 8 discharge port 30.

The construction of the discharge port 30 is now described with reference to FIG. 7.

A tip part 24 of the lower member 18 is formed so as to be substantially parallel with the carrying path. Also, the upper surface of the lower member 18 forms a straight line from the right end 22*a* of the liquid reservoir 22 to the tip part 24, and forms the lower surface 26*a* of the discharge passage 26. Of this lower surface 26*a* of the discharge passage 26, the area near the tip part 24 constitutes a lower edge part 30*a* of the discharge port 30.

The upper member 16 is so fitted that it covers the lower surface 26*a* of the discharge passage 26. The lower surface of this upper member 16 forms a straight line, and a curved surface shaped portion extending from the right end 26*b* of the upper surface of the discharge passage 26 to the tip part 28 of the upper member 16 constitutes an upper edge part 30*b*.

Figure 7:
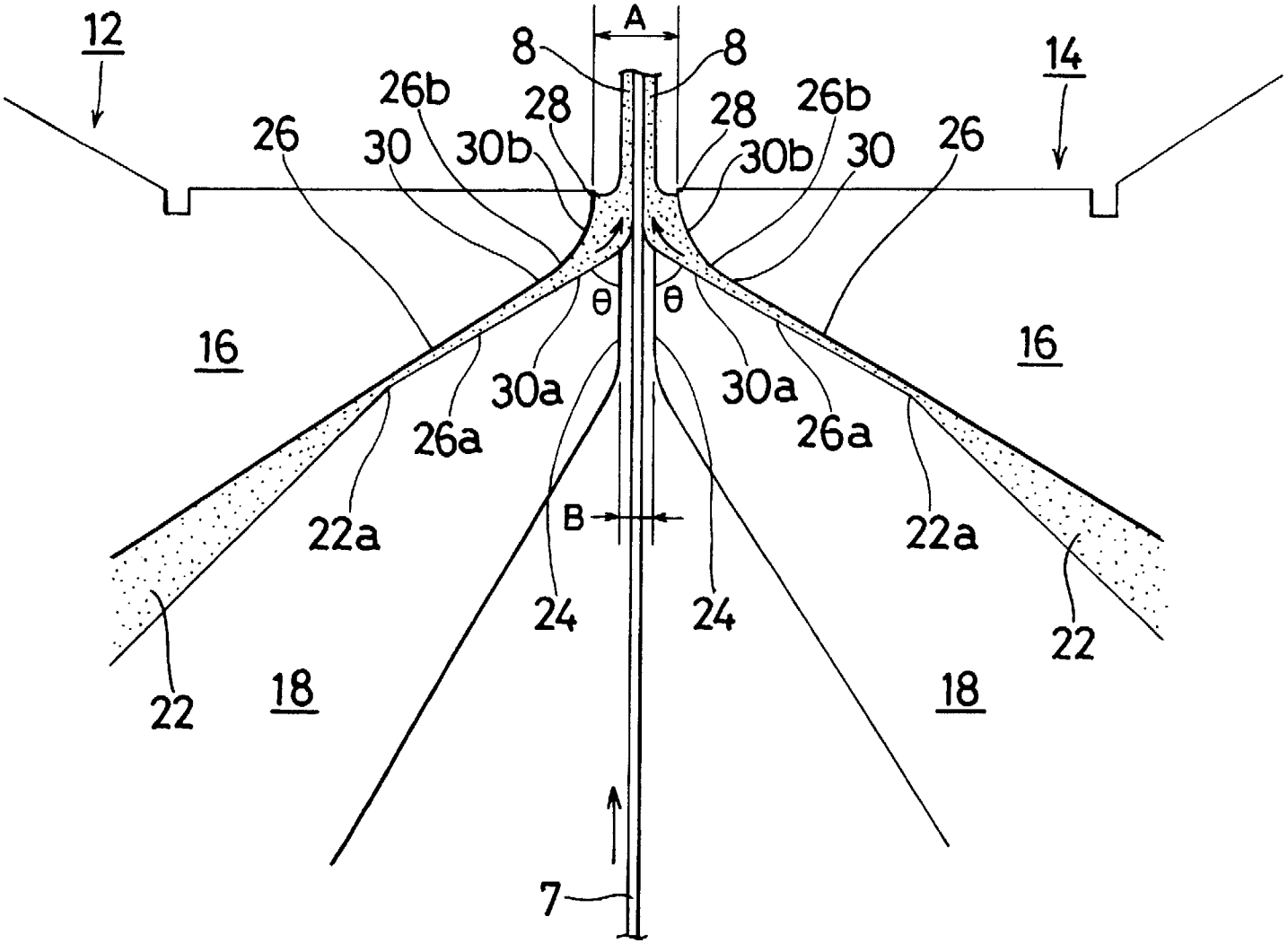
FIG. 7 is an enlarged detail view of discharge ports of the left-right pair of dies.

The inclination angle of this discharge passage 26, as shown in FIG. 7, is set so that the angle θ it makes with the tip part 24 of the lower member 18 is $0°<\theta<90°$, and preferably $30°<\theta<70°$.

The lower edge part 30*a* of the lower member 18 projects further toward the carrying path than the upper edge part 30*b* of the upper member 16, and when the pair of dies 12, 14 are brought to face each other the gap A between the tip parts 28 of the upper members 16 is larger than the gap B between the tip parts 24 of the lower members 18.

The lower edge part 30*a* constitutes a web 7 entry side edge part and the upper edge part 30*b* constitutes a web 7 exit side edge part.

The reference numeral 34 designates a projecting part projecting from the upper surface of the upper member 16 and extending in the width direction. This projecting part 34 has a channel 32 cut into it vertically and extending in the width direction. First bolts 36 are disposed horizontally in this projecting part 34, and the size of the gap of the channel 32 changes according to the state of tightening of these first bolts 36. Th at is, when these first bolts 36 are tightened, the gap of the channel 32 becomes narrow and the tip part 28 of the upper member 16 is raised. In this way it is possible to increase the height of the discharge passage 26. A plurality of the first bolts 36 are provided in the width direction of the web 7 so that the tip part 28 of the upper member 16 is always raised uniformly in the width direction of the web 7.

The reference numeral 40 designates a second bolt fixed to the left end of the lower member 18 and having its tip pressing against the left end of the upper member 16. When this second bolt 40 is tightened, the upper member 16 moves with respect to the lower member 18 toward the carrying path and the above-mentioned dimensional difference between the gap A and the gap B decreases.

The reference numeral 42 designates a pressure sensor mounted on the upper member 16 for measuring the pressure of the liquid reservoir 22.

The reference numeral 44 designates a hose for supplying coating liquid 8 to the inlet port 20.

The reference numeral 50 designates rotation shafts projecting from the front and rear surfaces of the lower member 18. The left die 12 is supported by this front-rear pair of rotation shafts 50, 50.

The right die 14 is formed left-right symmetrically with the same construction as the left die 12 described above.

Figure 9:
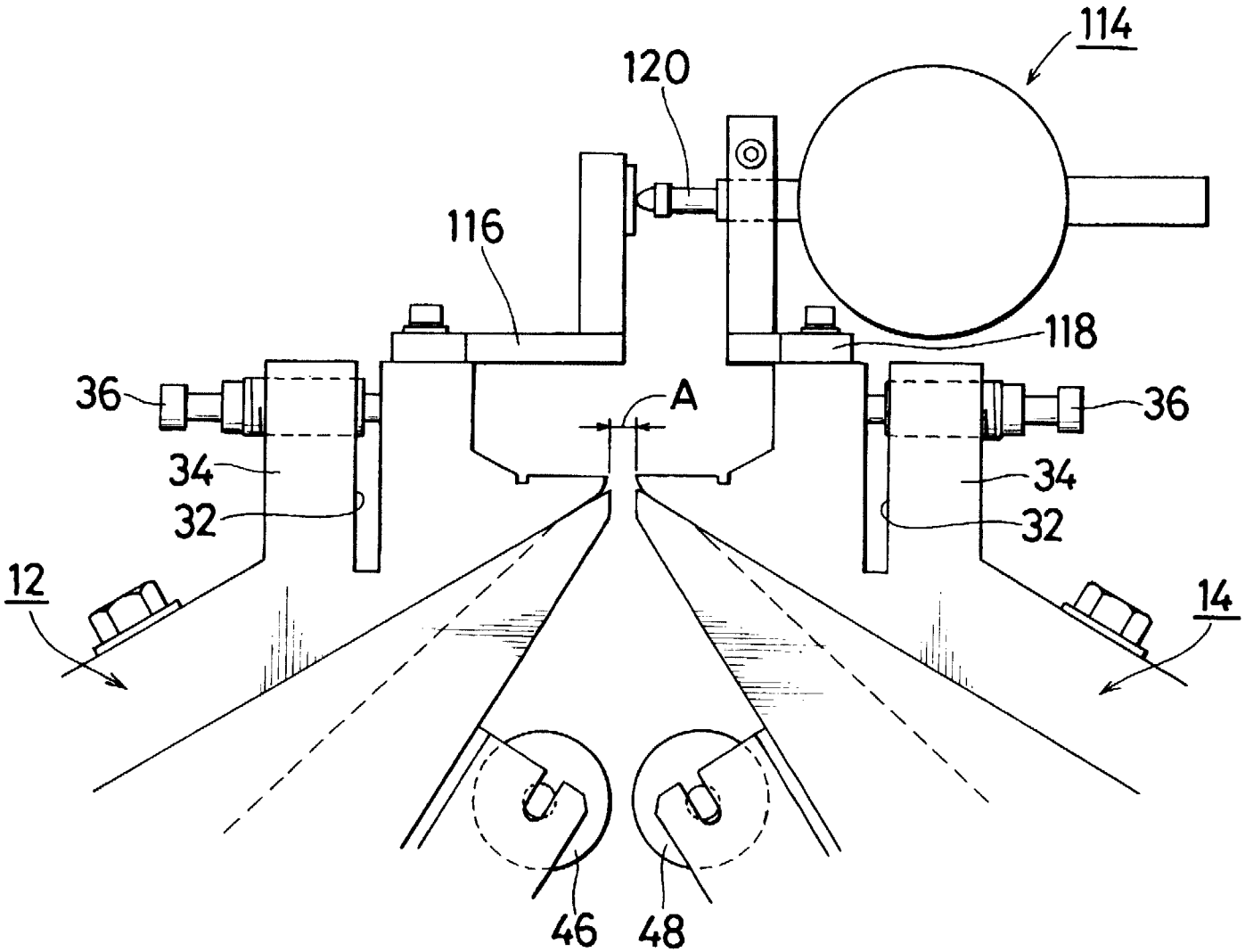
FIG. 9 is a view illustrating adjustment of a gap between the left-right pair of dies.

The reference numerals 46 and 48, as shown in. FIG. 9, are guide rollers disposed below the left-right pair of dies 12 and 14. These guide rollers 46, 48 enable the web 7 to be carried vertically. In this preferred embodiment a left-right pair of guide rollers 46, 48 are provided, but, in practice, when the web 7 approaches from the left side a guide roller 46 only is used and when the web 7 approaches from the right side a guide roller 48 only is used.

(Construction of Support Apparatus)

Figure 2:
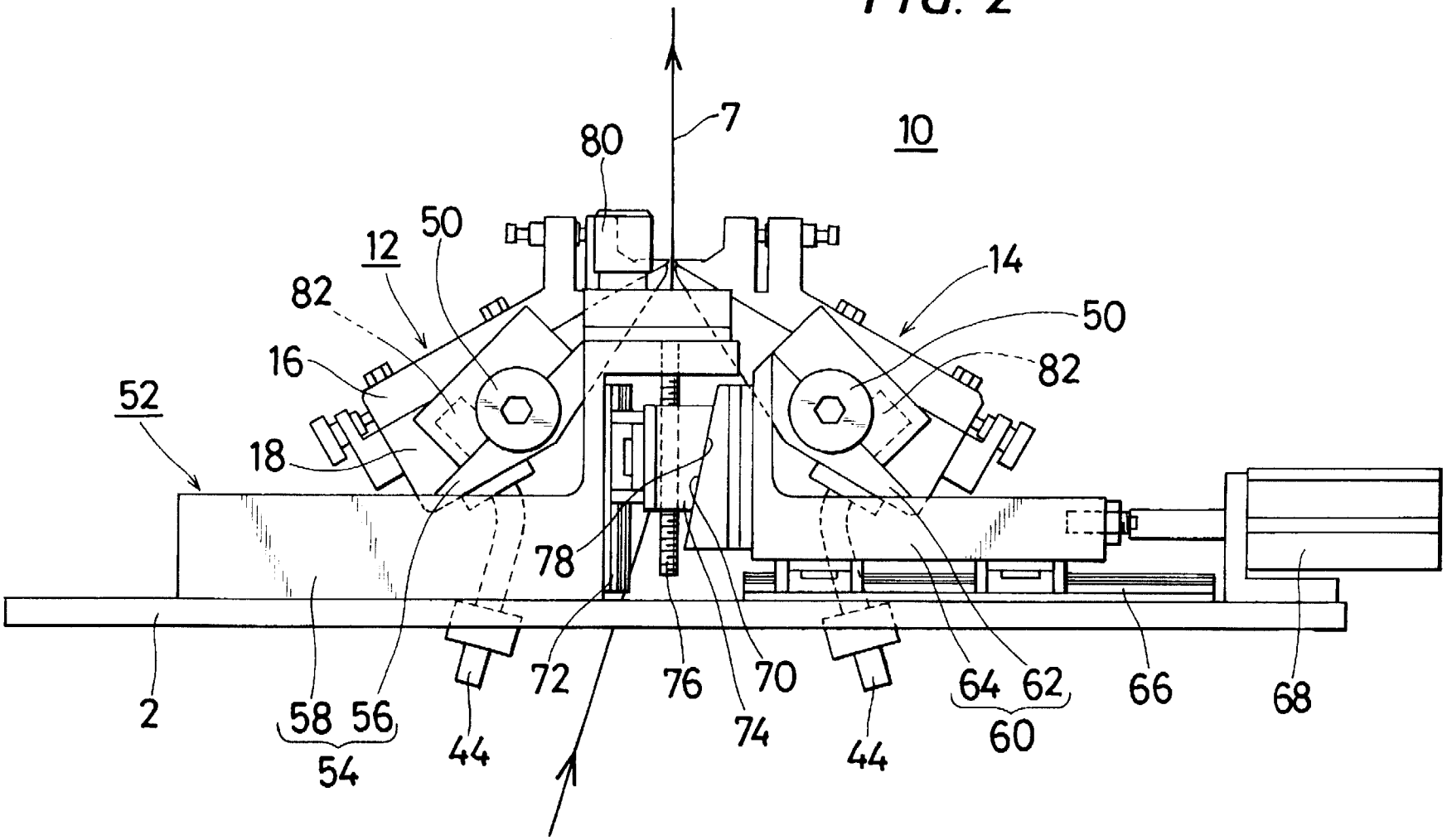
FIG. 2 is a side view of the coating apparatus of FIG. 1.

A support apparatus 52 for supporting the left-right pair of dies 12, 14 at the front and rear ends thereof is now described with reference to FIG. 2.

A front-rear pair of support parts 54 which support the left die 12 comprise a front-rear pair of bearing parts 56 for receiving the rotation shafts 50 projecting from the front and rear of the left die 12, and these bearing parts 56 are fixed to a left side fixed bed 58. This left side fixed bed 58 is fixed to the installation bed 2. The rotation shafts 50 are rotatably mounted in the bearing parts 56.

A front-rear pair of support parts 60, which support the right die 14, comprise a front-rear pair of bearing parts 62 for receiving the rotation shafts 50 projecting from the right die 14, and these bearing parts 62 are fixed to a right side movable bed 64. The right side movable bed 64 is movable with respect to the installation bed 2 in the left-right direction along a linear rail 66. An air cylinder 68 is attached to the right hand end of the right side movable bed 64 and urges the right side movable bed 64 toward the left at all times.

The left side face of the right side movable bed 64 has a sloping surface 70 sloping off the vertical direction.

A linear rail 72 is mounted vertically on the right side face of the left side fixed bed 58, and a vertically movable member 74 is vertically mounted on this linear rail 72. This vertically movable member 74 is screwed onto a screw rod 76 projecting vertically from a lower surface of a right end part of the left side fixed bed 58. The right side face of the vertically movable member 74 has a sloping surface 78 which makes contact with the sloping surface 70 of the right side movable bed 64. Also, the screw rod 76 is rotatable by a motor 80 mounted on an upper surface of a left end part of the left side fixed bed 58.

When the screw rod 76 is rotated by the motor 80, the vertically movable member 74 moves in the vertical direction along the linear rail 72. When this happens, the right side movable bed 64 making contact with the vertically movable member 74 is moved by the sloping surfaces 78, 70 in the left-right direction against the urging force of the air cylinder 68. When the right side movable bed 64 moves along the linear rail 66 in the left-right direction, the right die 14 moves in the left-right direction with respect to the left die 12 and the above-mentioned gap between the left and right dies 12 and 14 changes.

Motors 82, 82 are housed inside the left and right bearing parts 56 and 62 and can change the angles of the rotation shafts 50, 50 of the right die 14 and the left die 12.

c. Description of Control System of Coating Apparatus

Figure 8:
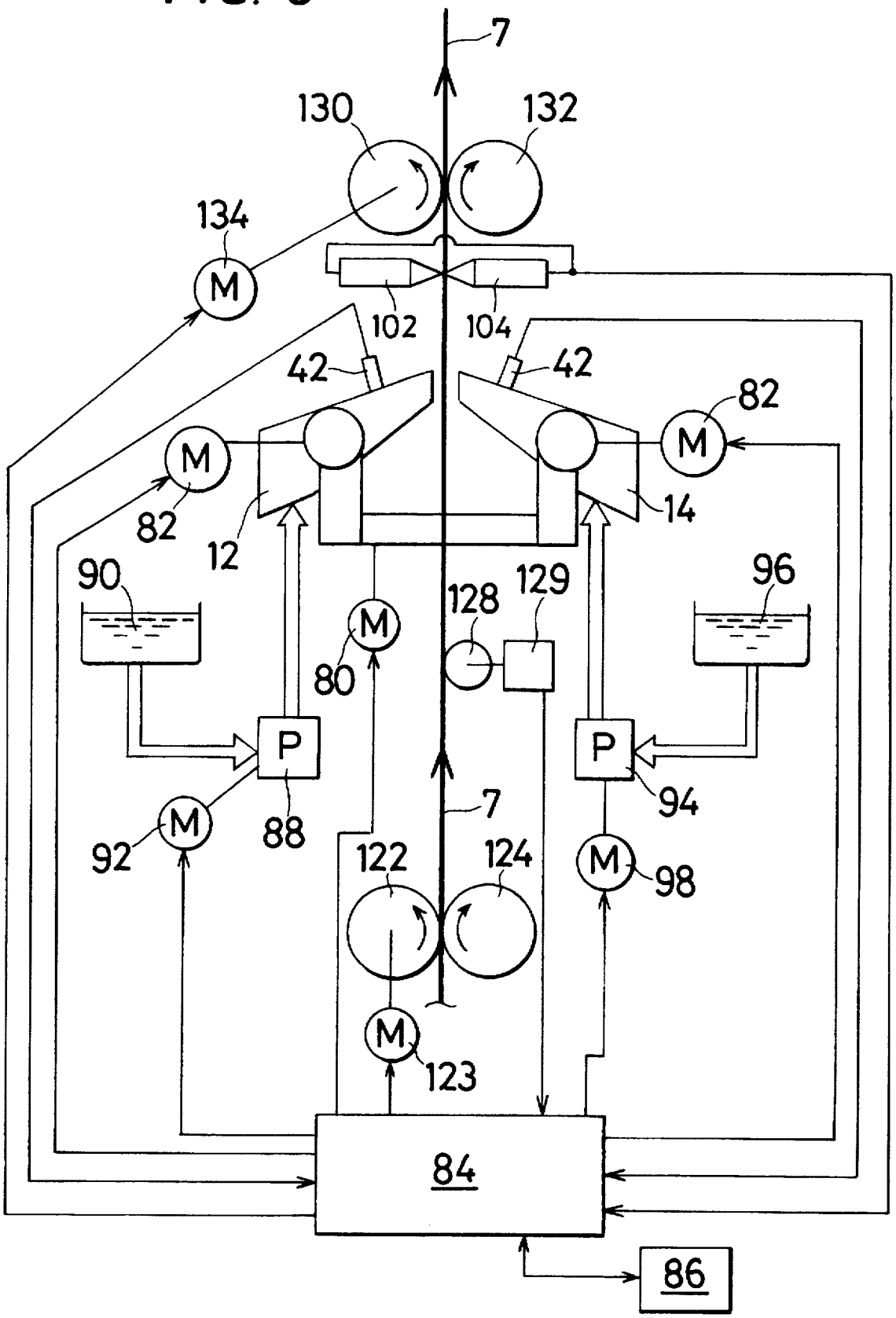
FIG. 8 is a block diagram of a control system of the coating apparatus.

FIG. 8 is a block diagram of a control system of the coating apparatus 10 centering on a controller 84. The controller 84 consists of an existing computer and has an operating part 86 for operating the coating apparatus 10.

Equipment appearing in FIG. 8 and not mentioned in the description thus far will now be described.

The reference numeral 88 designates a constant delivery pump for supplying a constant flow of coating liquid 8 through the hose 44 to the left die 12 from a coating liquid tank 90 which is operated by a motor 92.

The reference numeral 94 designates a constant delivery pump for supplying a constant flow of coating liquid 8 through the hose 44 to the right die 14 from a coating liquid tank 96 which is operated by a motor 98. The constant delivery pumps 88 and 94 are operated by the motors 92 and 98, but the amount of coating liquid 8 pumped per rotation of each of the constant delivery pumps 88 and 94 is fixed. Accordingly, the amount of coating liquid 8 supplied is increased by increasing the speed of the motors 92 and 98.

Also, if the speed N of the motors 92 and 98 is constant, the amount of coating liquid 8 supplied is also constant.

The reference numerals 102 and 104 designate coating thickness detectors for respectively detecting the coating thickness on either side of the web 7, and consist of β ray or infrared ray thickness gauges. These coating thickness detectors 102, 104 measure the coating thickness of the coating liquid 8 in a wet or dry state. Also, these coating thickness detectors 102, 104 detect the coating thickness while moving in the width direction of the web 7 at a constant speed. While moving, the coating thickness detectors 102, 104 detect average values of the coating thicknesses on both sides of each of a plurality of (for example seven) sections of the web 7 divided in the width direction. The detected average coating thicknesses of the plurality of sections on each side are used as measured coating thicknesses of both sides.

The motor 92 of the constant delivery pump 88, the motor 98 of the constant delivery pump 94, the motor 80 for moving the right side movable bed 64, the motor 82 for changing the angle of the left die 12 and the motor 82 for changing the angle of the right die 14, the infeed motor 123 and the outfeed motor 134 are connected to the controller 84 and the controller 84 controls the speed of each.

Also, signals from the pressure sensors 42, 42 mounted on the left die 12 and the right die 14 are inputted to the controller 84 and the pressures inside the liquid reservoirs 22, 22 are thereby measured.

The tension of the web 7 is measured by the tension measuring device 129.

Also, the coating thicknesses on both sides of the web 7 are measured by signals from the coating thickness detectors 102, 104.

Control carried out by this controller 84 is discussed in detail later.

d. Carrying State of the Web

The web 7 coated by this coating apparatus 10 is a mesh-form aluminum sheet, and the coating liquid 8 is a slurry composite consisting mainly of lithium manganese oxide. When this coating liquid 8 is coated onto this web 7, an electrode material of a lithium battery is produced.

The state in which the web 7 is carried is now described.

The web 7 pulled from the supply roller 3 passes around the three guide rollers 4, 4, 4 to the infeed roller 122.

The web 7 passes between the infeed roller 122 and the nip roller 124 and then passes around the guide roller 126 to the tension roller 128.

The web 7 then passes around the tension roller 128 and is carried into the coating apparatus 10.

After being coated, the web 7 passes through the drying apparatus 5 and drying of the coating liquid is carried out.

The web 7 with the coating liquid which has been dried then passes between the outfeed roller 130 and the nip roller 132 and is taken up on the takeup roller 6.

Here, the carrying velocity V of the web 7 is determined by the infeed motor 123. That is, the web 7 is nipped between the infeed roller 122 and the nip roller 124 and the web 7 is carried at a carrying velocity V by driving the infeed roller 122.

The outfeed motor 134 is controlled so that the outfeed roller 130 also rotates at the same speed as the infeed roller 122. As a result, the web 7 nipped between the outfeed roller 130 and the nip roller 132 is carried at the carrying velocity V.

Since it is a mesh-form aluminum sheet the web 7 stretches when a high tension is applied to it, therefore the web 7 must be carried at a low tension and under a constant tension. To this end, the tension of the web 7 is constantly monitored with the tension measuring device 129 mounted on the tension roller 128, and feedback control is carried out so that if the measured tension becomes high the speed of the outfeed roller 130 is reduced to below the speed of the infeed roller 122 to reduce the tension in the web 7.

e. Coating Operation of the Coating Apparatus (Setting of Initial State)

Setting of the initial state preceding duplex coating with the coating apparatus 10 will now be described.

Because as described above the web 7 is a mesh-form metal sheet, it is necessary to position the left-right pair of dies 12 and 14 left-right symmetrically.

To do this, the angles of inclination of the left die 12 and the right die 14 are set to the same inclination angle using the motors 82, 82.

Also, using the second bolts 40, the relationship of projection state between the upper member 16 and the lower member 18, i.e. the gap A and the gap B, is set. At this time, if the gap B is set as close as possible to the thickness of the web 7, it is possible to eliminate leaking of the coating liquid 8.

Here, the dies 12 and 14 are set so that they are left-right symmetrical.

Also, the sizes of the discharge passages 26 of the dies 12, 14 are each adjusted using the first bolts 36, 36.

These adjustments are carried out finely by carrying out test coating before production coating is commenced.

When adjusting the gap A and the gap B between the tip parts of the left-right pair of dies, a dial gauge 114 is deployed on the top of the projecting part 34 projecting from the upper member 16, as shown in FIG. 9. The dial gauge 114 is used in this case in the following way. A fixed member 116, which is the passive side of the dial gauge 114, is fixed to the top of the projecting part 34 of the left die 12. The gauge proper 118 of the dial gauge 114, which is the measuring side thereof, is mounted on the top of the projecting part 34 of the right die 14. In this way, the gap between the left-right pair of dies is measured from the position at which a measuring part 120, which is the tip part of the gauge proper 118, makes contact with the receiving surface of the fixed member 116. When this gap is adjusted, this adjustment is carried out by moving the right side movable bed 64 as described above.

(State During Coating)

Next, coating of coating liquid 8 onto both sides of the web 7 with the coating apparatus 10 is described.

The web 7 is arranged using the guide roller 46 so that it moves vertically upward between the pair of dies 12, 14 from below.

Coating liquid 8 is supplied at a constant flowrate to the liquid reservoirs 22, 22 of the left die 12 and the right die 14 from the constant delivery pumps 88, 94.

The coating liquid 8 inside the liquid reservoirs 22 flows out toward the discharge ports 30. At this time, because each of the liquid reservoirs 22 is formed so as to spread out in a fan shape from the inlet port 20, the coating liquid 8 flows smoothly to the discharge port 30 without stopping.

When coating liquid 8 is discharged from the discharge ports 30, 30 of the left-right pair of dies 12 and 14, coating liquid 8 is coated onto the web 7 from both sides thereof.

This coating state will now be described with reference to FIG. 7.

At the tip part 24 of the lower member 18, no coating pressure acts on the web 7. On the other hand, because the upper edge part **30*b* of the upper member 16 is formed in a curved surface shape, a coating pressure on the web 7** gradually increases and a maximum coating pressure acts at the position of the tip part 28 thereof and coats coating liquid discharged from the discharge port 30 onto the web 7 and makes this coating surface smooth. Also, at this time, because the upper edge part 30b is formed in a curved surface shape, the coating liquid 8 flows smoothly with respect to the web 7. That is, the structure of this upper member 16 from the upper edge part 30b to the tip part 28 constitutes a doctor edge.

Also, since the discharge passage 26 is inclined in the carrying direction of the web 7, the coating liquid 8 flows in the carrying direction of the web 7 toward the tip part 28 of the upper edge part 30b (see the arrows in FIG. 7) and does not leak out from between the tip parts 24, 24 of the lower members 18, 18 located in the opposite direction. Furthermore, because the gap B between the tip parts of the left side lower member 18 and the right side lower member 18 is narrower than the gap A between the left side upper member 16 and the right side upper member 16, the coating liquid 8 is completely prevented from leaking out.

Figure 10:
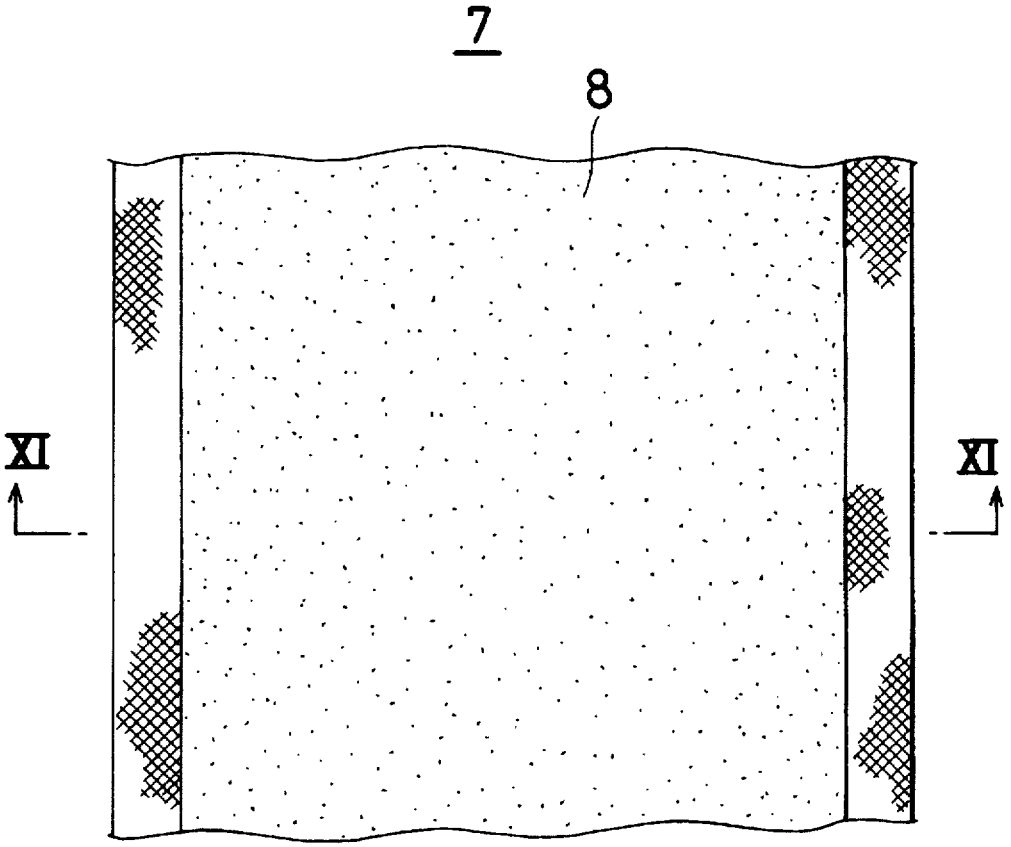
FIG. 10 is a plan view of a web coated using the coating apparatus of the preferred embodiment.
Figure 11:
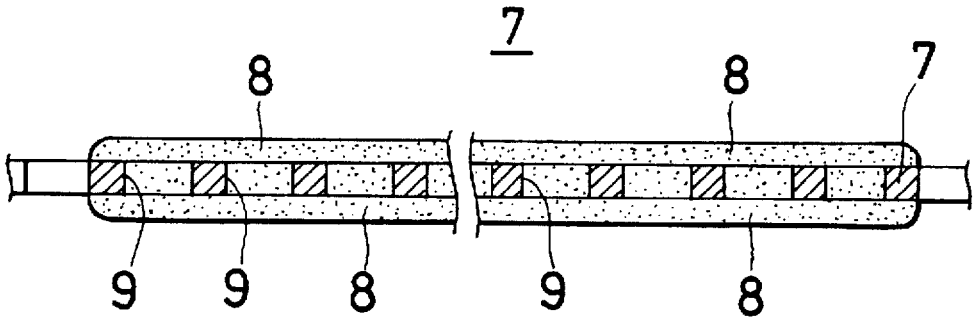
FIG. 11 is a sectional view on the line XI—XI in FIG. 10.

Since the same amount of coating liquid 8 is coated onto both sides of the web 7 from the left-right pair of dies 12 and 14, as shown in FIG. 10, both sides are coated with the same coating thickness. In this case, even if the web 7 is a mesh-form metal sheet, as shown in FIG. 11, the same amount of coating liquid 8 also penetrates into the insides of the through holes 9 formed by the mesh, and both sides are coated with the same coating thickness and in the same positions. As a result, it is possible to produce a coated sheet ideal as an electrode material of a lithium battery.

Also, when there is a seam in the web 7, it is possible to ensure that this seam portion travels smoothly between the pair of dies 12, 14 by making the gap between the pair of dies 12, 14 larger by moving the right side movable bed 64.

f. Details of Coating Apparatus Control Methods

Next, two different control methods of the coating apparatus 10 will be described.

(First Control Method)

Because the coating apparatus 10 of this preferred embodiment uses the method of coating the web 7 by ejecting the same amount of coating liquid 8 under pressure from each of the dies 12 and 14, the coating thickness is determined by the delivery rate of the constant delivery pumps 88 and 94. The delivery rate per unit time of these constant delivery pumps 88 and 94 is determined by the product of the carrying velocity and the coating width and the coating thickness of the web 7, i.e. by the volume of the coating.

The coating thickness in this case is the coating thickness in the wet state. Also, the delivery rate of the coating liquid 8 per unit time is determined by the speed of the constant delivery pumps 88 and 94. Here, what is important is that to make the coating thickness the same on both sides of the web 7 it is necessary to eject the same amount of coating liquid 8 from each of the dies 12 and 14, and to this end the constant delivery pumps 88 and 94 must be operated so that they deliver at the same delivery rates.

Therefore, the speed N (rpm) of the constant delivery pumps 88 and 94 is determined by the following equation (1):

$$N=(D\times W\times V)/(K1\times Q) \quad (1),$$

where D is a set wet coating thickness (mm), W is a set coating width of the web (mm), Q is the delivery amount (cc/rev) per rotation of the constant delivery pumps 88 and 94 and K1 is a constant.

Because Q can be considered a constant once the type of the constant delivery pumps 88 and 94 has been decided, equation (1) becomes:

$$N=(D\times W\times V)/K2 \quad (2),$$

where K2=K1×Q.

Therefore, if values of a wet coating thickness D and a coating width W are inputted into the controller 84 via the operating part 86 and the carrying velocity V of the web 7 is inputted into the controller 84 via an AD convertor, the controller 84 controls the motors 92 and 98 for driving the constant delivery pumps 88 and 94 so that the pump speed N of the constant delivery pumps 88 and 94 assumes the value given by the equation (2).

As a result, the speed N of the constant delivery pumps 88 and 94 automatically follows up changes in the carrying velocity V and, even if the carrying velocity V changes, the coating liquid 8 is coated with the same coating thickness and the same coating width at all times.

(Second Control Method)

Because changes to the coating thickness and the coating width are not usually carried out during coating, the coating thickness D and the coating width W in equation (2) can be considered as constants. Therefore, equation (2) can be expressed:

$$N=K3\times V \quad (3),$$

where $$K3=D\times W/K2 \quad (3').$$

K3 includes the coating thickness D, but because the coating thickness D sometimes fluctuates, it is necessary to measure the average value Dp over the whole coating width of each side by means of the coating thickness detectors 102, 104 and reflect fluctuation in this Dp in K3. Therefore, looking from a different viewpoint of that of equation (3'), i.e. from the viewpoint of coating thickness only, K3 becomes:

$$K3=Ds/Dp\times K0 \quad (4),$$

where Ds is a set coating thickness and K0 is a constant.

By substituting equation (4) into equation (3), the speed N of the constant delivery pumps 88 and 94 corresponding to a set coating thickness becomes:

$$N=(Ds\times V\times K0)/Dp \quad (5).$$

As a result, because not only does the speed N follow up changes in the carrying velocity V but also it is possible to respond to changes in the coating thickness, it is possible to coat coating liquid 8 with the same coating thickness and coating width at all times.

The coating thickness of the web 7 is controlled by the two control methods described above, and in this way uniform coating of both sides of the web 7 at the same thickness is possible.

SECOND PREFERRED EMBODIMENT

Figure 13:
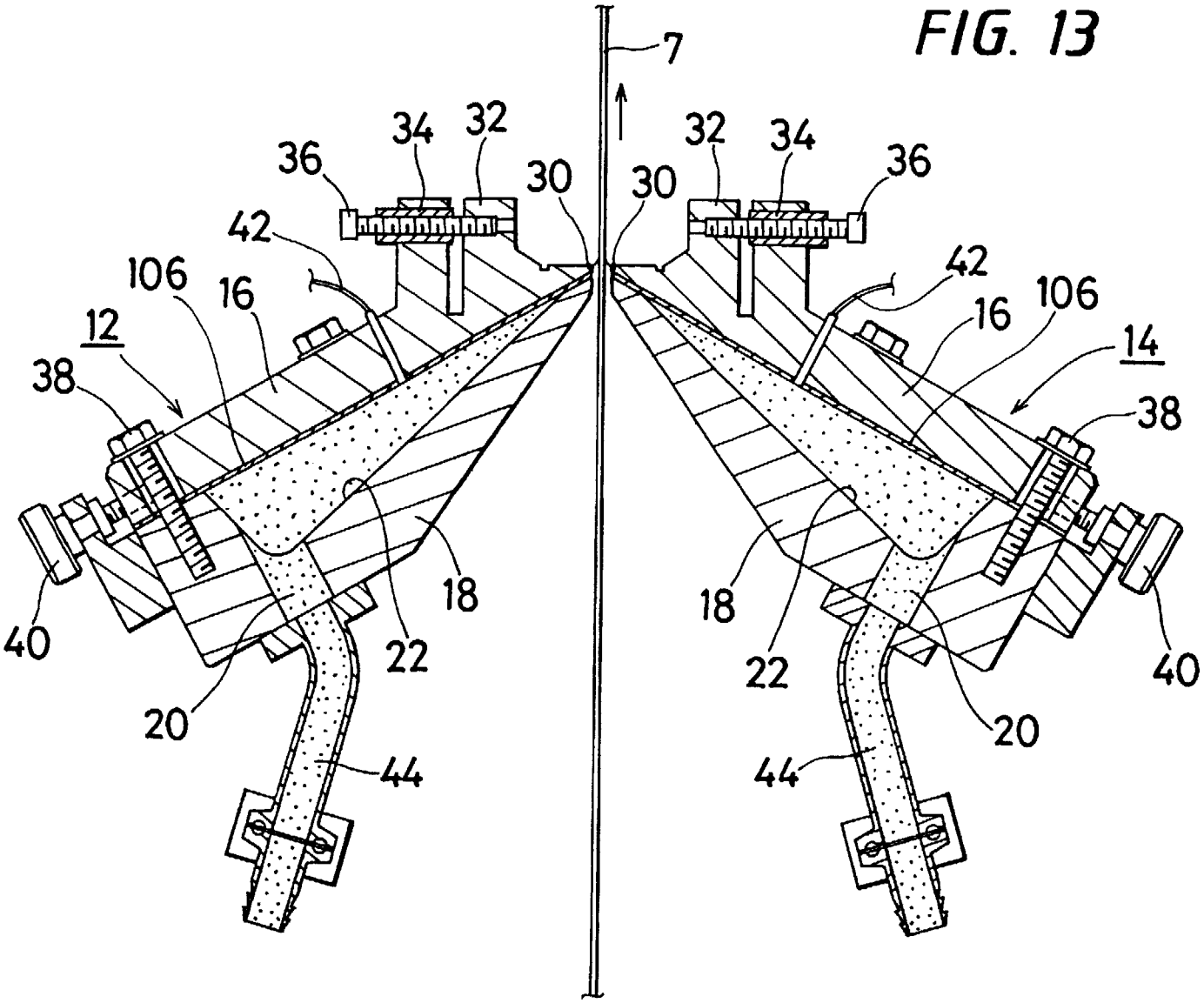
FIG. 13 is a sectional view of a left-right pair of dies with stripe coating members disposed between upper members and lower members.
Figure 14:
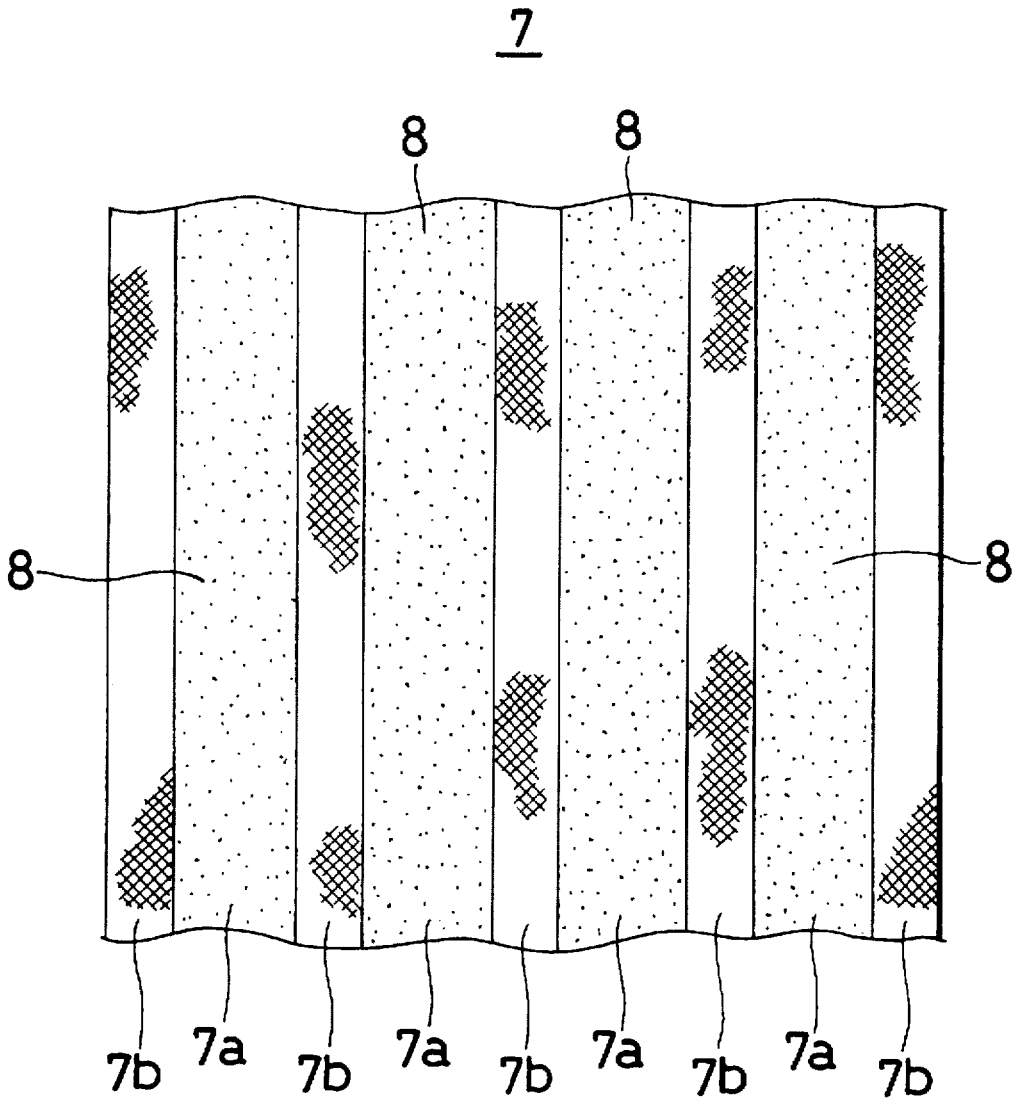
FIG. 14 is a plan view of a stripe-coated web.

Next, a second preferred embodiment of a coating apparatus 10 will be described with reference to FIG. 12 through FIG. 14.

The coating apparatus 10 of this preferred embodiment is capable of stripe coating, and the point different from the coating apparatus 10 of the first preferred embodiment is the point that a stripe coating members 106 for stripe coating is provided between the upper member 16 and the lower member 18.

Figure 12:
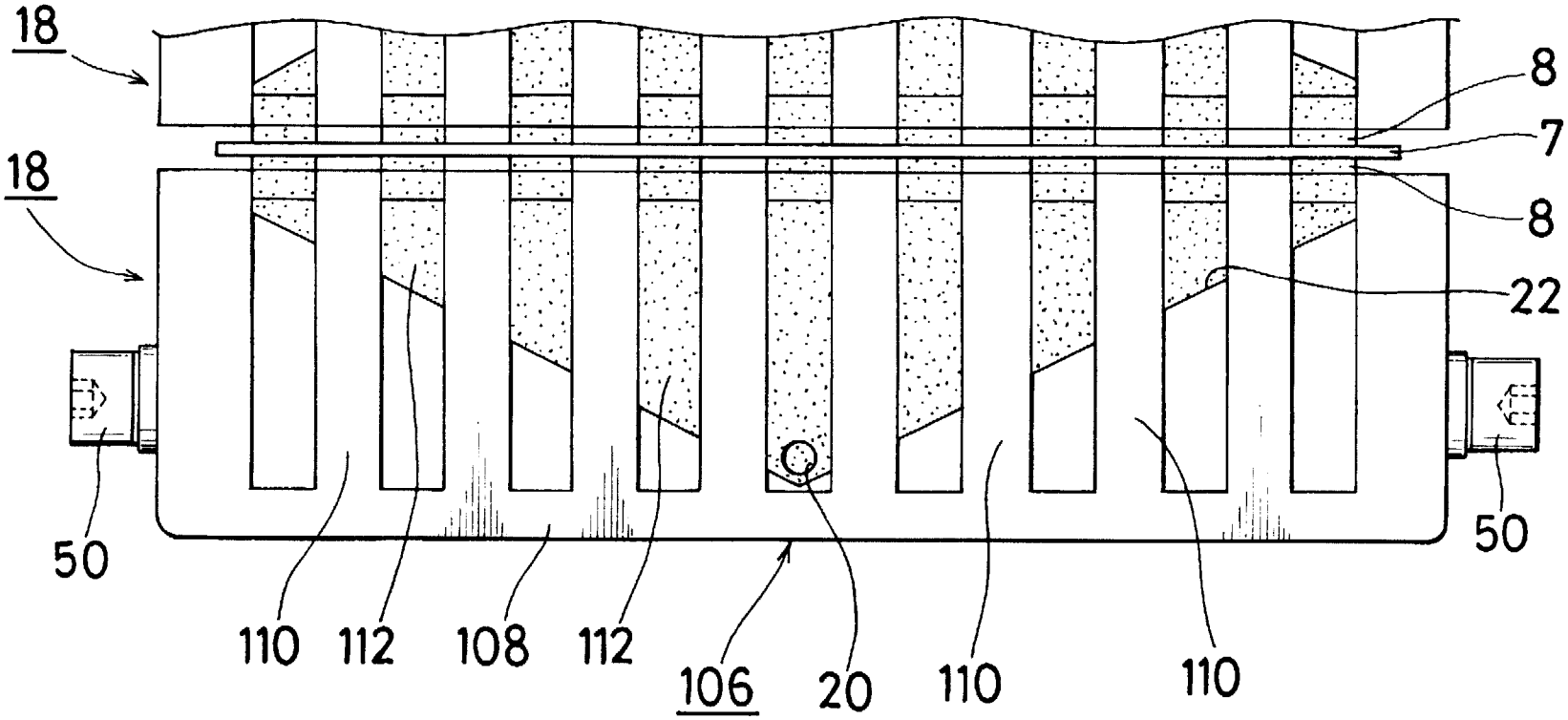
FIG. 12 is a plan view of a stripe coating member provided in a lower member.

This stripe coating member 106 is platelike and in plan view is comb-shaped, as shown in FIG. 12. That is, multiple blocking parts 110 project from a base part 108 extending in the width direction. This stripe coating member 106 is fixed sandwiched between the upper member 16 and the lower member 18 and divides the discharge passage 26 into multiple discharge spaces 112 between the blocking parts 110. That is, coating liquid 8 is not discharged from the parts of the discharge passage 26 blocked by the blocking parts 110 but coating liquid 8 is discharged from the discharge spaces 112 between the blocking parts 110. As a result, the coating liquid 8 discharged from the pair of dies 12, 14 is sorted between coated parts *7a* and uncoated parts *7b*, and the web 7 coated by this coating apparatus 10 is stripe-coated as shown in FIG. 14.

MODIFICATION EXAMPLES a. Modification Examples of Shape of Tip Part of Die

Modification examples of the shape of the tip parts of the upper member 16 and the lower member 18 will now be described with reference to FIG. 15 through FIG. 17.

Figure 15:
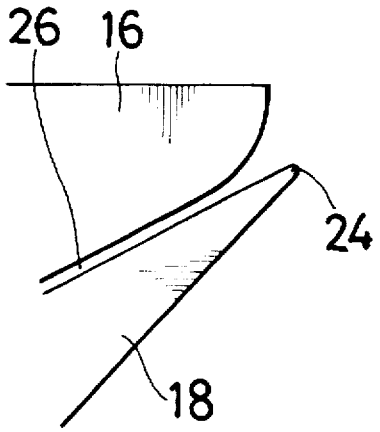
FIG. 15 is a first modification example of a die tip part.

FIG. 15 is a first modification example wherein the tip part 24 of the lower member 18 comes to a point in a triangular shape.

Figure 16:
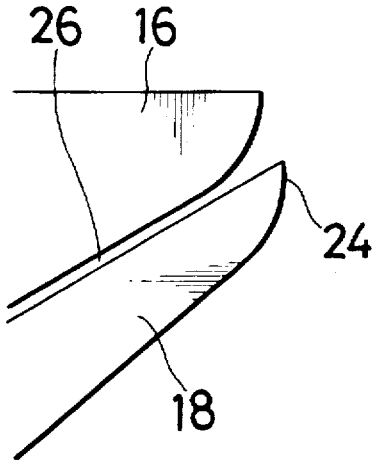
FIG. 16 is a second modification example of a die tip part.

FIG. 16 is a second modification example wherein the tip part 24 of the lower member 18 is shaped into a circular arc.

Figure 17:
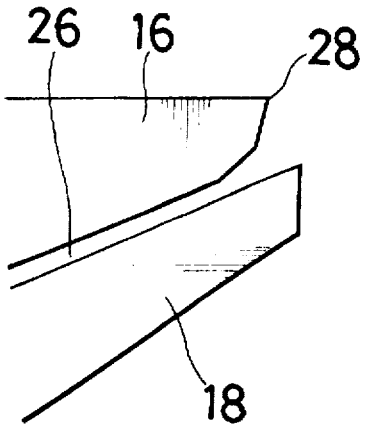
FIG. 17 is a third modification example of a die tip part.

FIG. 17 is a third modification example wherein the shape of the upper member 16 approaching the tip part 28 is not a curved surface but is polygonal.

b. Modification Example of Web 7

In the first preferred embodiment a mesh-form metal sheet was used as a web 7 of an electrode material of a lithium battery, but instead of this a porous metal sheet may alternatively be used. Also, when copper is used as the metal of the sheet, a slurry composite mainly consisting of carbon is suitable.

In the preferred embodiment described above, because a mesh-form metal sheet was used as the web 7, it was necessary to dispose the left-right pair of dies 12 and 14 left-right symmetrically, and also in the case of a porous metal sheet made by making holes in a metal sheet with a punch it is similarly necessary to dispose the left-right pair of dies 12 and 14 left-right symmetrically.

However, when duplex coating of a web 7 made of ordinary cloth or the like not having holes therein is to be carried out, it is not always necessary to dispose the dies 12 and 14 left-right symmetrically. That is, the right die 14 may be disposed slightly higher than the left die L2.

In this case, even if the web 7 shakes slightly in the left-right direction, it will not make contact with the tip parts of either of the dies 12 and 14.

c. Modification Example of Installation Angle of Coating Apparatus

In the first preferred embodiment and the second preferred embodiment, cases wherein the web 7 is carried vertically upward were described, but it is also possible to use the coating apparatus 10 in cases wherein the web 7 is carried horizontally instead. In this case, all that is necessary is that the left-right pair of dies 12 and 14 described above be disposed as an upper/lower pair.

Also, even if the web 7 carrying direction is slightly inclined, if the coating apparatus 10 is disposed orthogonally with respect to that carrying direction, it is possible to use the coating apparatus 10 even if the web 7 carrying path is inclined.

Furthermore, it is possible to use a coating apparatus according to this invention even in cases where the web 7 is carried vertically downward from above. In this case particularly, because the web 7 is carried downward from above, there is absolutely no leaking of coating liquid 8 in the opposite direction to the carrying direction, i.e. in the upward direction, and complete coating is carried out.

d. Other Modification Examples

In the preferred embodiments described above, the inclination angles of the left-right pair of dies 12 and 14 were adjusted by means of motors 82, 82, but this may alternatively be done manually.

Also, although in the preferred embodiments described above the right side movable bed 64 was moved by a motor 80, instead of this the right side movable bed 64 may alternatively be moved by rotating the screw rod 76 manually using a handle or the like.

What is claimed is:

1. A duplex type coating apparatus for applying a coating liquid to a web, comprising:

a pair of dies disposed on opposite sides of a carrying path of said web;

each of said dies having a liquid reservoir for holding said coating liquid;

each of said dies having a tip portion with a discharge port extending in a widthwise direction of the web for discharging said coating liquid onto opposite sides of said web;

each of said dies having a coating liquid discharge passage extending from the liquid reservoir to the discharge port;

coating liquid supplying means for supplying coating liquid to the liquid reservoirs such that the duplex type coating apparatus applies said coating liquid to both sides of said web by discharging same amounts of said coating liquid from each of said discharge ports onto the web;

said discharge ports being disposed opposite one another and each having a web entry side edge part and a web exit side edge part;

said web entry side edge parts projecting further toward said web than said web exit side edge parts such that the web exit side edge parts define an exit gap therebetween, the web entry side edge parts define an entry gap therebetween and said exit gap is wider than said entry gap so that the coating liquid is prevented from leaking from between said discharge ports; and the web exit side edge parts each having a curved surface extending from the coating liquid discharge passage to the tip part of each of the dies so that a coating pressure of the coating liquid discharged from the discharge passages increases from a lower level adjacent said web entry side edge parts to a higher level adjacent the web exit side edge parts.

2. The duplex type coating apparatus according to claim 1 wherein the tip portion of the entry side edge part of the discharge port of each of the pair of dies has a surface parallel to the carrying path.

3. The duplex type coating apparatus according to claim 2 wherein there is provided die moving means for moving at least one of the pair of dies in a direction orthogonal to the carrying path and the gap between the pair of dies is thereby made variable.

4. The duplex type coating apparatus according to claim 1 wherein there is provided die turning means for changing an angle of inclination of the pair of dies with respect to the carrying path to thereby make said angle of inclination variable.

5. The duplex type coating apparatus according to claim 1 wherein the discharge passages have discharge spaces capable of discharging said coating liquid and blocked spaces not capable of discharging said coating liquid formed alternately in the widthwise direction of the web.

6. The duplex type coating apparatus according to claim 1 further comprising:

carrying velocity detecting means for detecting a carrying velocity V of the web;

a constant delivery pump means for supplying a fixed delivery amount of said coating liquid per rotation to each of the liquid reservoirs of the pair of dies in a same quantity; and controlling means for controlling a speed N of the constant delivery pump means on the basis of the carrying velocity V from the carrying velocity detecting means such that:

$$N=(D\times W\times V)/(K1\times Q),$$

where D is a set wet coating thickness, W is a set coating width of the web, Q is the delivery amount per rotation of the constant delivery pump and K1 is a constant.

7. The duplex type coating apparatus according to claim 1 further comprising:

carrying velocity detecting means for detecting a carrying velocity V of the web;

a constant delivery pump means for supplying a fixed delivery amount of said coating liquid per rotation to each of the liquid reservoirs of the pair of dies in a same quantity;

coating thickness detecting means for detecting an average coating thickness Dp along the widthwise direction of the web; and controlling means for controlling a speed N of the constant delivery pump means on the basis of the carrying velocity V from the carrying velocity detecting means and the average coating thickness Dp from the coating thickness detecting means such that:

$$N=(Ds\times V\times K0)/Dp$$

where Ds is a set wet coating thickness and K0 is a constant.

8. A coating system for applying a coating liquid to a web, comprising:

a duplex type coating apparatus including:

a pair of dies disposed on opposite sides of a carrying path of said web;

each of said dies having a liquid reservoir for said coating liquid;

each of said dies having a tip portion with a discharge port extending in a widthwise direction of the web for discharging said coating liquid onto opposite sides of said web;

each of said dies having a coating liquid discharge passage extending from the liquid reservoir to the discharge port;

coating liquid supplying means for supplying coating liquid to the liquid reservoirs such that the duplex type coating apparatus applies said coating liquid to both sides of said web by discharging a same amount of coating liquid from each of the discharge ports onto the web;

said discharge ports being disposed opposite one another and each having a web entry side edge part and a web exit side edge part;

said web entry side edge parts projecting further toward said web than said web exit side edge parts such that the web exit side edge parts define an exit gap therebetween, the web entry side edge parts define an entry gap therebetween and said exit gap is wider than said entry gap so that said coating liquid is prevented from leaking from between said discharge ports; and said coating liquid discharge passages being inclined relative to said web so as to approach said web along a portion of said web upstream from said discharge ports as determined by travel of said web;

an infeed roller for feeding said web into the duplex type coating apparatus;

a nip roller disposed so as to nip the web with the infeed roller;

an infeed motor for driving the infeed roller;

tension measuring means for measuring the tension of the web, the tension measuring means being disposed in the carrying path between the infeed roller and the duplex type coating apparatus;

drying means for drying said coating liquid coated onto the web by the duplex type coating apparatus;

an outfeed roller for carrying the web dried by the drying means;

a nip roller disposed so as to nip the web with the outfeed roller;

an outfeed motor for driving the outfeed roller; and controlling means for driving the infeed motor so that the web is carried at a set carrying velocity and driving the outfeed motor so that the tension of the web measured by the tension measuring means assumes a predetermined value.

9. The duplex type coating apparatus according to claim 1 wherein the coating liquid discharge passages are inclined relative to said web so as to approach said web along a portion of said web upstream from said discharge ports as determined by travel of said web.

* * * * *